US008091809B2

(12) United States Patent
Hu et al.

(10) Patent No.: US 8,091,809 B2
(45) Date of Patent: Jan. 10, 2012

(54) SHREDDER WITH JAM PROOF SYSTEM

(75) Inventors: Jin Hu, Suzhou (CN); Qingcheng Cai, Suzhou (CN); Aiyu Huang, Suzhou (CN); Michael D Jensen, Wood Dale, IL (US)

(73) Assignee: Fellowes, Inc., Itasca, IL (US)

( * ) Notice: Subject to any disclaimer, the term of this patent is extended or adjusted under 35 U.S.C. 154(b) by 40 days.

(21) Appl. No.: 12/409,896

(22) Filed: Mar. 24, 2009

(65) Prior Publication Data

US 2010/0243774 A1 Sep. 30, 2010

(51) Int. Cl.
*B02C 25/00* (2006.01)

(52) U.S. Cl. ..... 241/30; 241/100; 241/236; 241/34

(58) Field of Classification Search ..... 241/30, 241/34, 36, 100, 236
See application file for complete search history.

(56) References Cited

U.S. PATENT DOCUMENTS

| | | | |
|---|---|---|---|
| 2,221,516 | A | 4/1937 | Hathaway |
| 3,619,537 | A | 11/1971 | Nara et al. |
| 3,724,766 | A | 4/1973 | Bosland |
| 3,764,819 | A | 10/1973 | Muller |
| 3,785,230 | A | 1/1974 | Lokey |
| 3,829,580 | A | 8/1974 | Guetersloh |
| 3,947,734 | A | 3/1976 | Fyler |
| 4,192,467 | A | 3/1980 | Hatanaka |
| 4,352,980 | A | 10/1982 | Hibari |
| 4,489,897 | A | 12/1984 | Turner |
| 4,495,456 | A | 1/1985 | Vercillo et al. |
| 4,497,478 | A | 2/1985 | Reschenhofer |
| 4,683,381 | A | 7/1987 | Dufoug |
| 4,707,704 | A | 11/1987 | Allen |

(Continued)

FOREIGN PATENT DOCUMENTS

DE 3313232 10/1984

(Continued)

OTHER PUBLICATIONS

U.S. Appl. No. 60/613,750, filed Sep. 27, 2004, Pierce.

(Continued)

*Primary Examiner* — Faye Francis
(74) *Attorney, Agent, or Firm* — Pillsbury Winthrop Shaw Pittman LLP

(57) ABSTRACT

A shredder is disclosed having a jam proof system. In one embodiment, the jam proof system provides a thickness detector having a contact member which displaces as an article is inserted into a throat of the shredder and a resistance generating mechanism configured to provide a resistance force to the contact member, in response to displacement of the contact member. The greater the thickness of the material the greater the resistance force that will be realized. When the material reaches a predetermined thickness, there will be a significant change in the resistance force. The resistance generating mechanism may include at least two spring mechanisms serially arranged, such as, a first spring mechanism and a second spring mechanism. This feature provides immediate and direct feedback to the user that the article inserted into the shredder may be too thick. In addition, the thickness detector may include a sensor, and in particular, a Hall effect sensor assembly configured to measure the thickness of the article inserted into the throat. The sensor may communicate with a controller that is configured to alert the user, and/or alter the operation of the shredder, in response to the thickness of the material. For example, the controller may visually and/or audibly alert the user, or control the shredder motor response.

24 Claims, 6 Drawing Sheets

U.S. PATENT DOCUMENTS 4,757,949 A 7/1988 Horton
4,814,632 A 3/1989 Glaeser
4,842,205 A 6/1989 Araki
4,889,291 A 12/1989 Goldhammer et al.
4,914,721 A 4/1990 Glaeser
5,017,972 A 5/1991 Daughton
5,081,406 A 1/1992 Hughes et al.
5,166,679 A 11/1992 Vranish et al.
5,167,374 A 12/1992 Strohmeyer
5,186,398 A 2/1993 Vigneau, Jr.
5,198,777 A 3/1993 Masuda et al.
5,342,033 A 8/1994 Iwata
5,345,138 A 9/1994 Mukaidono et al.
5,353,468 A 10/1994 Yap
5,397,890 A 3/1995 Schueler et al.
5,409,171 A 4/1995 Stangenberg et al.
5,415,355 A 5/1995 Gollwitzer
5,429,313 A 7/1995 Schwelling
5,453,644 A 9/1995 Yap
5,494,229 A 2/1996 Rokos
5,662,280 A 9/1997 Nishio et al.
5,743,521 A 4/1998 Munakata et al.
5,772,129 A 6/1998 Nishio et al.
5,775,605 A 7/1998 Tsai
5,823,529 A 10/1998 Mandel
5,850,342 A 12/1998 Nakamura et al.
5,871,162 A 2/1999 Rajewski
5,924,637 A 7/1999 Niederholtmeyer
D412,716 S 8/1999 Kroger
5,942,975 A 8/1999 Sorenson
D414,198 S 9/1999 Iwata
5,988,542 A 11/1999 Henreckson
6,065,696 A 5/2000 Tsai
D426,805 S 6/2000 Iwata
6,079,645 A 6/2000 Henreckson et al.
6,116,528 A 9/2000 Schwelling
6,141,883 A 11/2000 Mitchell et al.
6,265,682 B1 7/2001 Lee
6,376,939 B1 4/2002 Suzuki et al.
6,418,004 B1 7/2002 Mather et al.
6,550,701 B1 4/2003 Chang
6,561,444 B1 5/2003 Yokomine et al.
6,601,787 B1 8/2003 Langenecker
6,655,943 B1 12/2003 Peterson
6,666,959 B2 12/2003 Uzoh et al.
6,676,460 B1 1/2004 Motsenbocker
6,698,640 B2 3/2004 Hakozaki
6,724,324 B1 4/2004 Lambert
6,802,465 B1 10/2004 Norcott et al.
6,979,813 B2 12/2005 Avril
6,983,903 B2 1/2006 Chang
6,997,408 B2 2/2006 Watano
7,025,293 B2 4/2006 Matlin et al.
7,040,559 B2 5/2006 Matlin
7,166,561 B2 1/2007 Allen
7,213,780 B2 5/2007 Chen
7,311,276 B2 12/2007 Matlin et al.
7,520,452 B2 4/2009 Watano et al.
7,624,938 B2 12/2009 Aries et al.
7,631,822 B2 12/2009 Matlin et al.
7,631,823 B2 12/2009 Matlin et al.
7,631,824 B2 12/2009 Matlin et al.
7,635,102 B2 12/2009 Matlin et al.
7,661,614 B2 2/2010 Matlin et al.
7,663,769 B2 2/2010 Hayashihara et al.
7,712,689 B2 5/2010 Matlin et al.
2003/0042342 A1 3/2003 Kroger et al.
2004/0008122 A1 1/2004 Michael
2004/0069883 A1 4/2004 Watanabe et al.
2004/0159198 A1 8/2004 Peot et al.
2004/0194594 A1 10/2004 Dils et al.
2004/0226800 A1 11/2004 Pierga
2005/0150986 A1 7/2005 Castronovo
2006/0016919 A1 1/2006 Castronovo
2006/0054725 A1 3/2006 Matlin
2006/0091247 A1 5/2006 Matlin
2006/0219827 A1 10/2006 Matlin et al.
2006/0243631 A1 11/2006 Duke
2007/0007373 A1 1/2007 Matlin et al.
2007/0025239 A1 2/2007 Jain et al.
2007/0080252 A1 4/2007 Pierce
2007/0087942 A1 4/2007 Allen
2007/0164135 A1 7/2007 Zhong
2007/0164138 A1 7/2007 Allen
2007/0215728 A1 9/2007 Priester
2007/0221767 A1 9/2007 Matlin
2007/0246580 A1 10/2007 Matlin et al.
2007/0246581 A1 10/2007 Matlin et al.
2007/0246582 A1 10/2007 Aries et al.
2007/0246585 A1 10/2007 Matlin et al.
2007/0246586 A1 10/2007 Matlin et al.
2008/0093487 A1 4/2008 Lee
2008/0231261 A1 9/2008 Dengler et al.
2009/0025239 A1 1/2009 Pan
2009/0032629 A1 2/2009 Aries et al.
2009/0090797 A1 4/2009 Matlin et al.
2010/0051731 A1 3/2010 Matlin et al.
2010/0084496 A1 4/2010 Matlin et al.
2010/0102153 A1 4/2010 Matlin et al.
2010/0134805 A1 6/2010 Pan
2010/0176227 A1 7/2010 Davis et al.
2010/0181398 A1 7/2010 Davis et al.
2010/0213296 A1* 8/2010 Sued et al. ..... 241/36
2010/0213297 A1* 8/2010 Sued et al. ..... 241/36
2010/0213300 A1 8/2010 Matlin et al.
2010/0243774 A1 9/2010 Hu et al.
2010/0252661 A1 10/2010 Matlin et al.
2010/0252664 A1 10/2010 Matlin et al.
2010/0270404 A1 10/2010 Chen
2010/0282879 A1 11/2010 Chen
2010/0288861 A1 11/2010 Cai et al.
2010/0320297 A1 12/2010 Matlin et al.
2010/0320299 A1 12/2010 Matlin et al.

FOREIGN PATENT DOCUMENTS

DE 8619856 10/1988
DE 4121330 1/1993
DE 4207292 1/1993
DE 4237861 5/1994
DE 4437348 4/1996
DE 19835093 2/1999
DE 202004000907 5/2005
DE 102006036136 1/2008
DE 202010001577 U1 11/2010
EP 268244 11/1987
EP 562076 9/1992
EP 524708 1/1997
EP 0792691 9/1997
EP 0818241 1/1998
EP 856945 1/1998
EP 855221 7/1998
EP 1177832 2/2002
EP 1195202 4/2002
EP 2180290 7/2008
EP 2022566 2/2009
GB 1199903 7/1970
GB 2171029 8/1986
GB 2209963 6/1989
GB 2440651 2/2008
GB 2442942 4/2008
GB 2451513 2/2009
JP 52-11691 1/1977
JP 57-070445 4/1982
JP 57-070445 (U) 4/1982
JP 57-76734 5/1982
JP 58-223448 12/1983
JP 61-000702 1/1986
JP 63-173342 11/1988
JP 2-277560 11/1990
JP H2-303550 12/1990
JP 04-157093 5/1992
JP 04-0180852 6/1992
JP 5-96198 4/1993
JP H05-092144 4/1993
JP 6-277548 10/1994
JP 7-299377 11/1995
JP 8-108088 4/1996

| | | |
|---|---|---|
| JP | 8-131861 | 5/1996 |
| JP | 08-164343 | 6/1996 |
| JP | 9-38513 | 2/1997 |
| JP | 09-150069 | 10/1997 |
| JP | 9-262491 | 10/1997 |
| JP | 10-048344 | 2/1998 |
| JP | 11-216383 | 8/1999 |
| JP | 11-304942 | 11/1999 |
| JP | 2000346288 | 12/2000 |
| JP | 2002-239405 | 8/2002 |
| JP | 2002239405 | 8/2002 |
| JP | 2004321993 | 11/2004 |
| WO | 2005070553 | 8/2005 |
| WO | 2006019985 | 2/2006 |
| WO | 2006036370 | 4/2006 |
| WO | 2007109753 | 9/2007 |
| WO | 2007122364 | 11/2007 |
| WO | 2007137761 | 12/2007 |

OTHER PUBLICATIONS

U.S. Appl. No. 60/686,490, filed May 31, 2005, Pierce.

U.S. Appl. No. 60/688,295, filed Jun. 7, 2005, Pierce.

Acco Rexel, Mainstream 1050/2150/2250/3150/3250 and 3350, 115V Machines Illustrated Parts Lists and Services Instructions, Mar. 25, 2002, Issue No. 4.

Acco Rexel, Deckside and Office 115V Machines Illustrated Parts Lists and Service Instructions, Aug. 18, 1999.

Acco Rexel, Deckside and Office 230V Machines Illustrated Parts Lists and Service Instructions, Aug. 1, 2000.

Complaint for Declaratory Judgment filed on Nov. 15, 2010 by Royal Applicance Manufacturing Co., d/b/a/ TTI Floor Care North America and Techtronic Industries Co. Ltd. against Fellowes, Inc.

English Translation of Japanese Patent Application Publication No. 9-38513, published on Feb. 10, 1997.

* cited by examiner

SHREDDER WITH JAM PROOF SYSTEM

FIELD

This application generally relates to shredders for destroying articles, such as paper documents, compact disks, etc.

BACKGROUND

Shredders are well-known devices for destroying articles, such as documents, CDs, floppy disks, etc. Further, users purchase shredders to destroy sensitive articles, such as credit card statements with account information, documents containing company trade secrets, etc.

A common problem with shredders is that persons attempt to shred articles which are too thick for the cutters to handle. As such, the cutters may become jammed and/or the motor or cutters could be damaged.

Examples of shredders with thickness sensor are shown, for example, in U.S. Patent Application Publication Nos. 2006/0054725; 2006/0219827; 2007/0221767; 2007/0246580; 2007/0246581; 2007/0246582; 2007/0246585; and 2007/0246586.

SUMMARY

According to one embodiment, a shredder is disclosed comprising: a housing having a throat for receiving at least one article to be shredded; a shredder mechanism positioned downstream of the throat in the direction that the articles are fed; and a contact member that is configured to displace as the article passes through the throat; and a resistance generating mechanism for resisting displacement of the contact member, the resistance generating mechanism comprising: (i) a first spring configured to resist displacement of the contact member at least up to a predetermined displacement; and (ii) a second spring configured to resist displacement of the contact member beyond the predetermined displacement, wherein the first and second springs are configured such that the ratio of force to displacement is lower below the predetermined displacement and greater beyond the predetermined displacement.

According to one embodiment, a method of shredding is disclosed comprising: inserting an article to be shredded into a housing having a throat for receiving articles to be shredded; displacing a contact member positioned in the throat, wherein the displacement corresponds to the thickness of the article in the throat; generating a resistance as the contact member displaces, said generating comprising: (i) providing a first resistance configured to resist displacement of the contact member at least up to a predetermined displacement; and (ii) providing a second resistance configured to resist displacement of the contact member beyond the predetermined displacement, wherein the first and second resistances are configured such that the ratio of force to displacement is lower below the predetermined displacement and greater beyond the predetermined displacement.

According to one embodiment, a shredder is disclosed comprising: a housing having a throat for receiving at least one article to be shredded; a shredder mechanism positioned downstream of the throat in the direction that the articles are fed; a contact member that is configured to pivotally displace as the article passes through the throat including a cam mechanism having a surface which contacts the article; and a sensor configured to measure a displacement of the contact member, the sensor comprising: (i) a pair of first elements spaced apart for one another; and (ii) a second element moveable with the displacement of the contact member so as to be displaced between the pair of first elements, wherein each of the first elements is one of a magnet and a Hall effect sensor, and the second element is the other of a magnet and a Hall effect sensor.

Other features of one or more embodiments of this disclosure will seem apparent from the following detailed description, and accompanying drawings, and the appended claims.

BRIEF DESCRIPTION OF THE DRAWINGS

Embodiments of the present disclosure will now be disclosed, by way of example only, with reference to the accompanying schematic drawings in which corresponding reference symbols indicate corresponding parts, in which.

DETAILED DESCRIPTION

According to one aspect of the application, a jam proof system is provided to detect the thickness of articles inserted into the shredder.

In one embodiment, the jam proof system provides a thickness detector having a contact member which displaces as an article is inserted into a throat of the shredder and a resistance generating mechanism configured to provide a resistance force to the contact member, in response to displacement of the contact member. The greater the thickness of the material the greater the resistance force that will be realized. When the material reaches a predetermined thickness, there will be a significant change in the resistance force. The resistance generating mechanism may include at least two spring mechanisms serially arranged, such as, a first spring mechanism and a second spring mechanism. This feature may provide immediate and direct feedback to the user that the article inserted into the shredder is too thick.

In addition, the thickness detector may include a sensor configured to measure the thickness of the article inserted into the throat. The sensor may communicate with a controller that is configured to alert the user, and/or alter the operation of the shredder, in response to the thickness of the material. For example, the controller may visually and/or audibly alert the user, or change the shredder motor response (e.g., deactivating the motor or change the speed or power).

Figure 1:
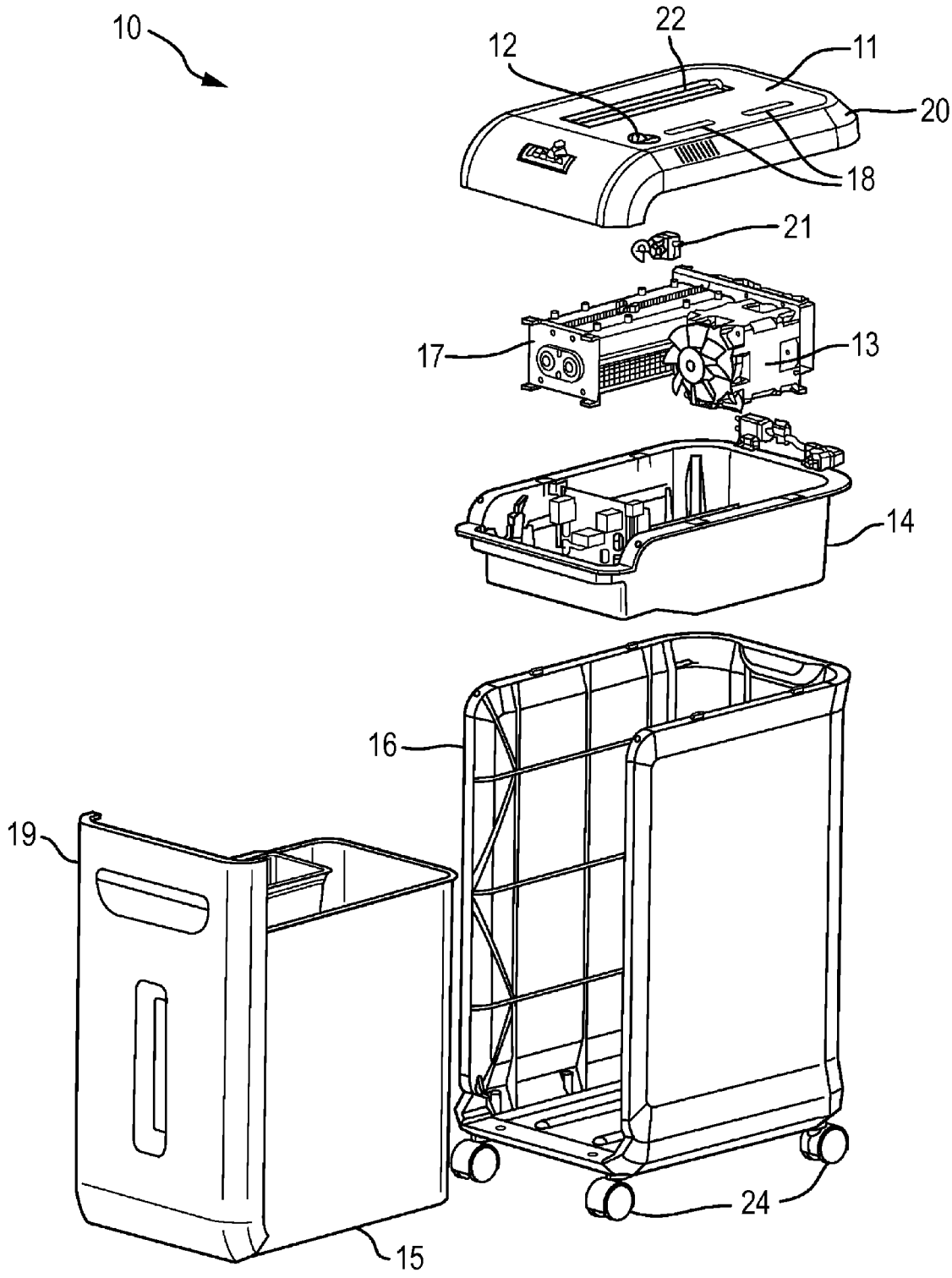
FIG. 1 shows a shredder constructed in accordance with an embodiment.

FIG. 1 shows a shredder constructed in accordance with an embodiment. The shredder is generally indicated at 10. The shredder includes a housing 20 having a throat 22 for receiving at least one article 31 to be shredded, a shredder mechanism 17 received in the housing 20, a thickness detector 21, and a controller 35 (FIG. 4) coupled to a electrically powered motor 13 and the thickness detector 21. The shredder mechanism 17 includes the motor 13 and cutter elements. The shredder mechanism 17 enables the at least one article to be shredded to be fed into the cutter elements. The motor 13 is operable to drive the cutter elements so that the cutter elements shred the articles fed therein. The thickness detector 21 is configured to detect a thickness of the at least one article 31 received by the throat 22. The controller 35 may be configured to vary the running operation of the motor responsive to the detector detecting the thickness of the at least one article being received by the throat 22.

The shredder 10 includes the shredder housing 20, mentioned above. The shredder housing 20 includes a top cover 11, and a bottom receptacle 14. The shredder housing 20 includes the top cover or wall 11 that sits atop the upper periphery of the bottom receptacle 14. The top cover or wall 11 is molded from a plastic material or any other material. The shredder housing 20 and its top wall or cover 11 may have any suitable construction or configuration. The top cover or wall 11 has an opening, which is often referred to as the throat 22, extending generally parallel and above the cutter elements. The throat 22 enables the articles being shredded to be fed into the cutter elements. As can be appreciated, the throat 22 is relatively narrow, which is desirable for preventing overly thick items, such as large stacks of documents, from being fed into cutter elements, which could lead to jamming. The throat 22 may have any configuration.

The shredder 10 includes the bottom receptacle 14 having a bottom wall, four side walls and an open top. The bottom receptacle 14 is molded from a plastic material or any other material. The bottom receptacle 14 sits atop the upper periphery of the bottom housing 16 in a nested relation using flange portions of the bottom receptacle 14 that generally extend outwardly from the side walls thereof. The shredder mechanism 17 along with the motor 13, and the thickness detector 21 are configured to be received in the bottom receptacle 14 of the shredder housing 20. The bottom receptacle 14 may be affixed to the underside of the top cover or wall 11 by fasteners. The receptacle 14 has an opening in its bottom wall through which the shredder mechanism 17 discharges shredded articles into the container 15.

As noted above, the shredder 10 includes the shredder mechanism 17 that includes the electrically powered motor 13 and a plurality of cutter elements. The term "shredder mechanism," as used herein, is a generic structural term to denote a device that destroys articles using at least one cutter element. Such destroying may be done in any particular way, such as by strip cutting or cross cutting. For example, the shredder mechanism may include at least one cutter element that is configured to punch a plurality of holes in the document or article in a manner that destroys the document or article. In the illustrated embodiment, the cutter elements are generally mounted on a pair of parallel rotating shafts. The motor 13 operates using electrical power to rotatably drive the shafts and the cutter elements through a conventional transmission so that the cutter elements shred articles fed therein. The shredder mechanism 17 may also include a sub-frame for mounting the shafts, the motor 13, and the transmission. The operation and construction of such a shredder mechanism 17 are well known and need not be described herein in detail. Generally, any suitable shredder mechanism 17 known in the art or developed hereafter may be used.

In the illustrated embodiment, the shredder 10 sits atop the large freestanding housing 16, which is formed of molded plastic material or any other material. The housing 16 includes a bottom wall, three side walls, an open front and an open top. The side walls of the container 16 provide a seat on which the shredder housing 20 is removably mounted. The housing 16 is constructed and arranged to receive the waste container 15 therein. In other words, the waste container 15 is enclosed in the housing 16. The waste container 15 is formed of molded plastic material or any other material. The waste container 15 is in the form of a pull-out bin that is constructed and arranged to slide in and out of the housing 16 through an opening in the front side thereof. The waste container 15 is configured to be removably received within the housing 16. The waste container 15 includes a bottom wall, four side walls, and an open top. The waste container 15 may also include a handle 19 that is configured to allow a user to grasp and pull out the waste container 15 from the housing 16. In the illustrated embodiment, the handle 19 is located on the front, side wall of the waste container 15. Any construction or configuration for the housing or waste container may be used, and the illustrated embodiment is not limiting.

As an option, the housing 16 along with the shredder 10 can be transported from one place to another by simply rolling the housing 16 on roller members 24, such as wheels or casters. In the illustrated embodiment, the housing 16 includes two pairs of roller members 24 attached to the bottom of the frame of the housing 16 to support the housing 16. The rolling members 24 can be located on the housing 16 as near the corners as practical. The roller members 24, in one embodiment, may be locked against rolling motion by lock members to provide a stationary configuration. In one embodiment, the front pair of the roller members 24 may be in the form of casters that provide a turning capability to the housing 16, while the rear pair of the roller members 24 may be in the form of wheels that are fixed in direction, so as to only allow roll in the intended direction of travel. In another embodiment, the front and rear pair of the roller members 24 may in the form of casters.

The cover 11 may include a switch 12 recessed with an opening therethrough. For example, an on/off switch 12 that includes a switch module may be mounted to the top cover 11 underneath the switch recess by fasteners, and a manually engageable portion that moves laterally within the switch recess. The switch module has a movable element that connects to the manually engageable portion through the opening. This enables movement of the manually engageable portion to move the switch module between its states.

The switch module 12 is configured to connect the motor 13 to the power supply. This connection may be direct or indirect, such as via a controller. Typically, the power supply will be a standard power cord with a plug on its end that plugs into a standard AC outlet. The switch 12 may be movable between an on position and an off position by moving the manually engageable portion laterally within the switch recess. In the "on" position, contacts in the switch module are closed by movement of the manually engageable portion and the movable element to enable a delivery of electrical power to the motor 13. In the "off" position, contacts in the switch module are opened to disable the delivery of electric power to the motor 13. Alternatively, the switch 12 may be coupled to a controller, which in turn controls a relay switch, for controlling the flow of electricity to the motor 13, as will be described in detail below.

As an option, the switch 12 may also have a "reverse" position wherein contacts are closed to enable delivery of electrical power to operate the motor 13 in a reverse manner. This would be done by using a reversible motor and applying a current that is of a reverse polarity relative to the on position. The capability to operate the motor 13 in a reversing manner is desirable to move the cutter elements in a reversing direction for clearing jams. In the "off" position the manually engageable portion and the movable element would be located generally in the center of the switch recess, and the "on" and "reverse" positions would be on opposing lateral sides of the "off" position.

Generally, the construction and operation of the switch 12 for controlling the motor 13 are well known and any construction for such a switch may be used. For example, the switch 12 need not be mechanical and could be of the electro-sensitive type. Likewise, such as a switch may be entirely omitted, and the shredder can be started based on insertion of an article to be shredded.

One or more display indicators 18 may be located on the cover 11 (and/or on other locations of the shredder 10), for providing status to the user of one or features of the shedder. According to one or more embodiments, the display indicators 18 may provide visual and/or audible indication to the user regarding the thickness of the articles inserted into the throat 22 to be shredded. For example, the display indicators 18 may include one or light emitting diodes (LED), liquid crystal display (LCD), speaker, lamps, gauges, or other indicating means.

The shredder 10 may have any suitable construction or configuration and the illustrated embodiment is not intended to be limiting in any way. In addition, the term "shredder" is not intended to be limited to devices that literally "shred" documents and articles, but is instead intended to cover any device that destroys documents and articles in a manner that leaves each document or article illegible and/or useless.

Figures 2, 2A:
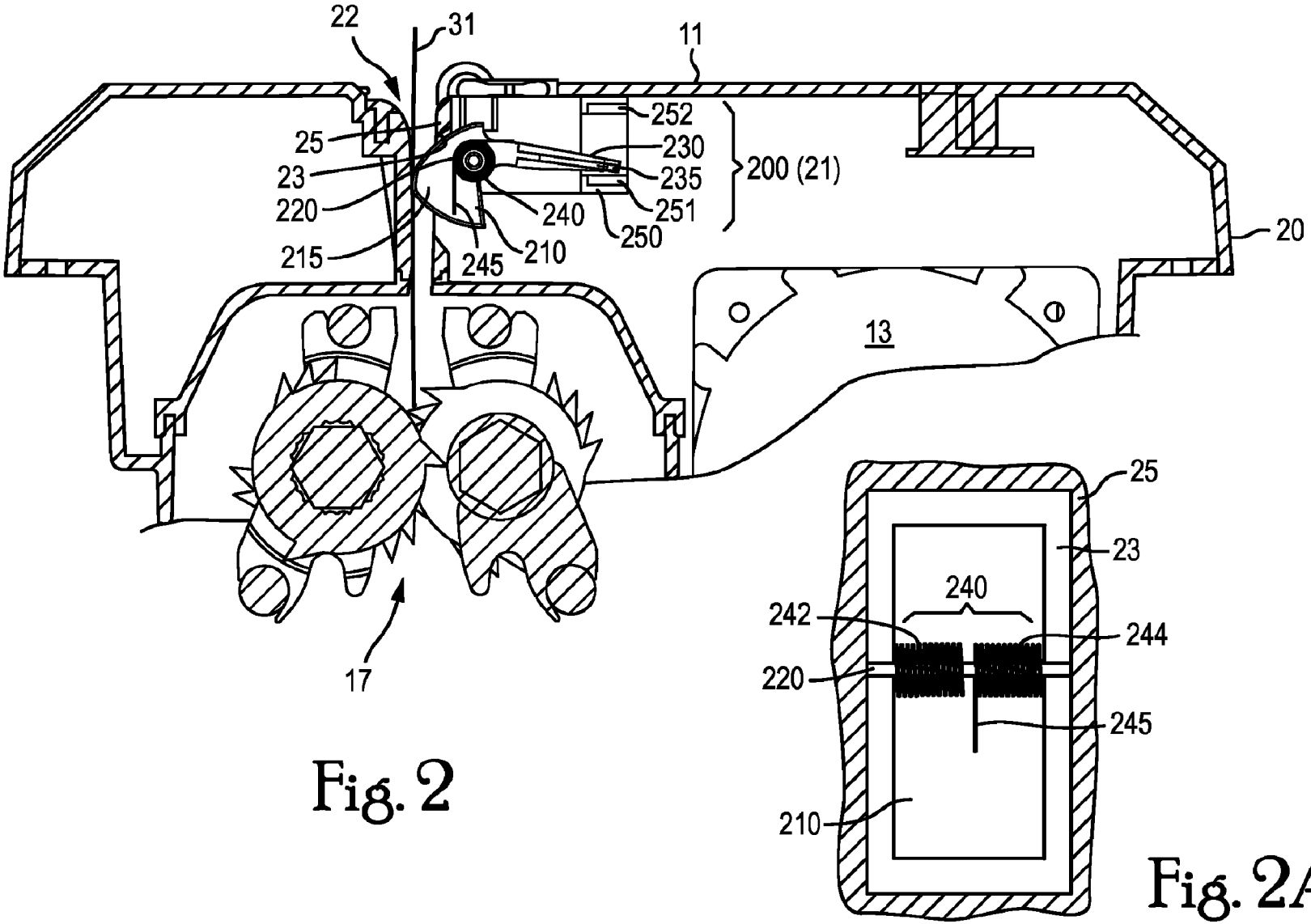
FIG. 2 shows a first embodiment for a thickness detector that may be used to detect the thickness of articles that are placed in the throat of the shredder.
FIG. 2A shows a cross-sectional view of a side opening in the throat of the shredder.

FIG. 2 shows a first embodiment 200 for a thickness detector 21 that may be used to detect the thickness of articles that are placed in the throat 22 of the shredder 10.

The figure shows a cross-sectional view of the throat 22 with the thickness detector 200 assembled therein. The throat 22 includes a narrow rectangular slot for receiving at least one article 31 to be shredded. Two sidewalls of the slot are shown therein. A side opening 23 in one sidewall 25 of the throat 22 may be provided for allowing the thickness detector 200 to extend and to displace therethrough, with respect to the opposite sidewall. While the side opening 23 is shown in the figure being on the right side of the throat 22, it will be appreciated that it may also be oriented on the left side of the throat 22.

The thickness detector 200 may include a contact member 210 that extends through the opening 23 and into the throat 22. The contact member 210 is displaceable in response to the article being inserted into the throat 22. In one implementation, the contact member 210 may include a cam mechanism 215 that pivots or rotates as the article 31 passes. As shown in FIG. 2, the contact member 210 may be pivotable about a pivot 220 (such as an axle or a shaft).

The contact member 210 may also include an arm 230 extending, substantially in the direction opposite from the cam mechanism 215. Thus, the cam mechanism 215 and the arm 230 may pivot together as a unit about the pivot 220.

Depending on the thickness of the article 31, the cam mechanism 215 and the arm 230 of the contact member 210 will displace as the user inserts an article into the throat 22. A zero point reference may be established when no article is inserted in the throat 22, and the contact surface 210 abuts the opposite sidewall of the throat 22.

FIG. 2A shows a cross-sectional view of the side opening 23 in the throat 22. A resistance generating mechanism 240 may be connected to the contact member 210, so as to provide a resistance force in response to the contact member 210 displacing. The resistance generating mechanism 240 may include at least two spring mechanisms serially arranged, such as, a first spring mechanism 242 and a second spring mechanism 244.

The resistance force generated by the resistance generating mechanism 240 will create a frictional force against an article 31 which may be felt by the user, especially when trying to feed articles into the throat 22. This resistance force may provide an immediate feedback to the user. As the user inserts article(s) 31 into the throat, the user may sense the resistance force being applied by the resistance generating mechanism 240. The resistance force also helps to bias the contact member 210 to return to its original position (i.e., the zero point reference) when no article 31 is present in the throat 22.

Figure 6:
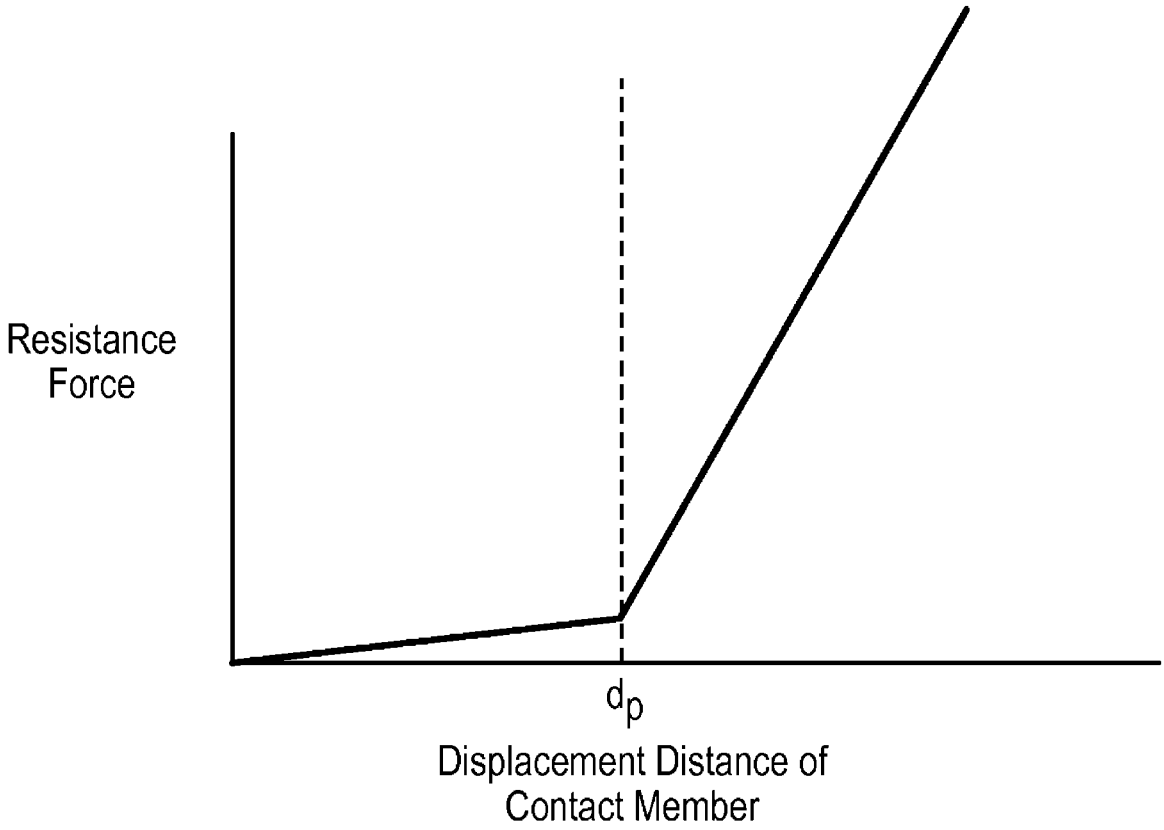
FIG. 6 shows a plot of the displacement of the contact member of the thickness detector and the resistance provided, in accordance with an embodiment.

The first spring mechanism 242 may be attached directly to the contact member 210, for example, proximate to the pivot 220. As the contact member 210 displaces so will the first spring member 242. On the other hand, the second spring mechanism 244 may not be directly attached to the contact member 210. The second spring mechanism 244 may be arranged proximate to the pivot 220 and include a projecting or floating leg 245 which the contact member 210 engages only after the contact member 210 is displaced a predetermined distance $d_p$ (FIG. 6). For example, a surface of the cam mechanism 215 (or projecting member thereof) may contact the leg 245 causing the second spring mechanism 244 to displace when the contact member 210 moves past the predetermined distance $d_p$.

The first spring mechanism 242 may be configured to provide a first resistance force to the contact member 210. The first spring mechanism 242 may be a torsion spring that obeys Hooke's Law. In one implementation, a spring constant may be expressed as a ratio of force to displacement. The first spring mechanism 242 may be a "soft" torsion spring having a relative low spring constant of about 0 to 0.5 N/m.

Displacement of the contact member 210 about the pivot 220 up until the predetermined thickness $d_p$, may generate only a very small resistance force via the first spring mechanism 242. For example, the first spring mechanism may be selected to provide just a low resistance force tending to return the contact member to its original position (i.e., the zero point reference).

On the other hand, the second spring mechanism 244 may be configured to provide a second resistance force, as the contact member 210 displaces greater than the predetermined thickness $d_p$,. The second spring mechanism 244 may be a torsion spring also.

In one implementation, the second spring mechanism 244 provides a resistance force much greater than the first spring mechanism 242. For example, the second spring mechanism 244 may be a "hard" torsion spring having a relatively large spring constant of about 0.5 to 2 N/m. As such, once the predetermined thickness $d_p$, has been exceeded, continued displacement by the contact member 210 will result in a significant increase in the resistance force. In other implementations, a non-linear spring might also be used for the first or second spring mechanism 244.

As shown in FIG. 6, for example, the first spring mechanism 242 may be engaged first, and then the second spring mechanism 244 may be applied, together with the first, once the contact member has displaced the predetermined distance $d_p$. Upon "feeling" the significant increase in resistance force, corresponding to the article exceeding the predetermined distance $d_p$,, the user will hopefully remove and/or reduce the thickness of the article(s) to be shredded.

In addition, or in the alternative, the use of a weaker first spring and a stronger second spring may limit the impact of document waving or "fluttering" during shredding. Because shredding agitates the paper, the paper in the throat may wave back and forth, thus moving the contact member. This may be potentially detected as an increase in thickness, when in reality the thickness has not increase. The use of the stronger spring resisting the movement of the contact member may reduce this effect, particularly since it provides more resistance to contact member displacement after being engaged.

Figure 4:
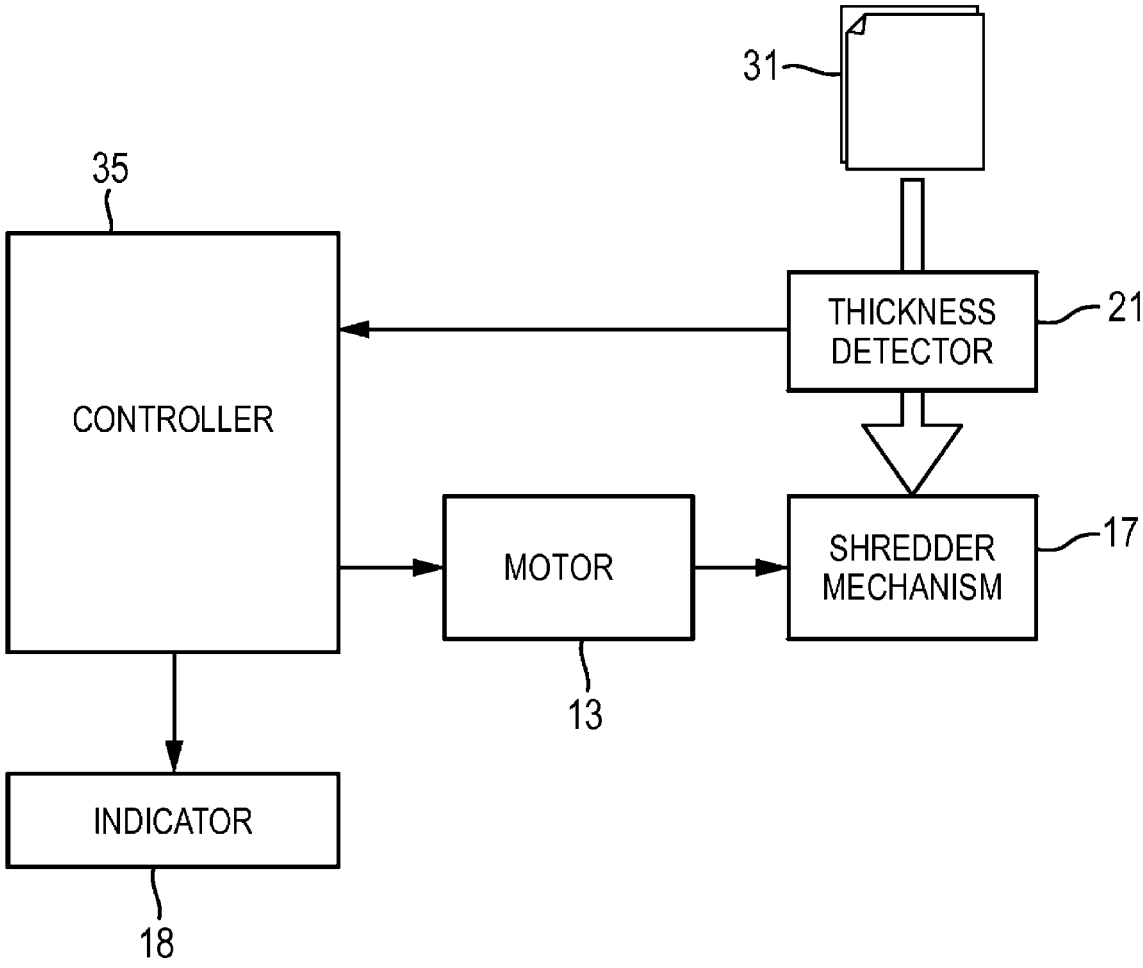
FIG. 4 shows an exemplary control architecture, in accordance with an embodiment.

In addition to or as an alternative to the resistance generating mechanism 240, the thickness detector 200 includes a sensor assembly 250 that is arranged and configured to accurately measure the displacement of the contact member 210. In one embodiment, a Hall effect sensor assembly 250 may be used that includes a Hall effect sensor 235. For example, the Hall effect sensor assembly 250 may be attached to a printed circuit board (PCB) that is connected to the controller 35 (FIG. 4). As shown in FIG. 2, the Hall effect sensor assembly 250 may be located proximate to a distal end of the arm 230. The Hall effect sensor 235 will detect this movement of the arm 230. When an article is inserted into the throat, it will cause the cam mechanism 215 to rotate a certain angle. In turn, the distal end of the arm 230 will move a certain distance proportionate to the angular displacement.

In one implementation, the Hall effect sensor assembly 250 may include a pair of Neodymium-Iron-Boron (NdFeB) permanent magnets 251, 252 which are spaced apart to provide a uniform magnetic field. The two magnets spaced apart may improve the accuracy of the measurements and provide a linear response to displacement, as opposed to a single magnet and sensor arrangement. For example, the magnets 251, 252 may be spaced apart 16 mm. The locations of the hall effect sensor 235 and the magnets 251, 252 could be reversed in some implementations. Other types of magnets might be similarly used as well. As the distal end of the arm 230 moves through the uniform magnetic field, a corresponding output voltage of the hall effect sensor 235 will be generated.

The controller 35 may correlate the output voltage of the Hall effect sensor 235 to the angular displacement of the contact member 210. For example, the output of the Hall effect sensor 235 may be substantially linear to the displacement of the sensor 235 within the magnetic field between magnets 251, 252.

Figures 3, 3A:
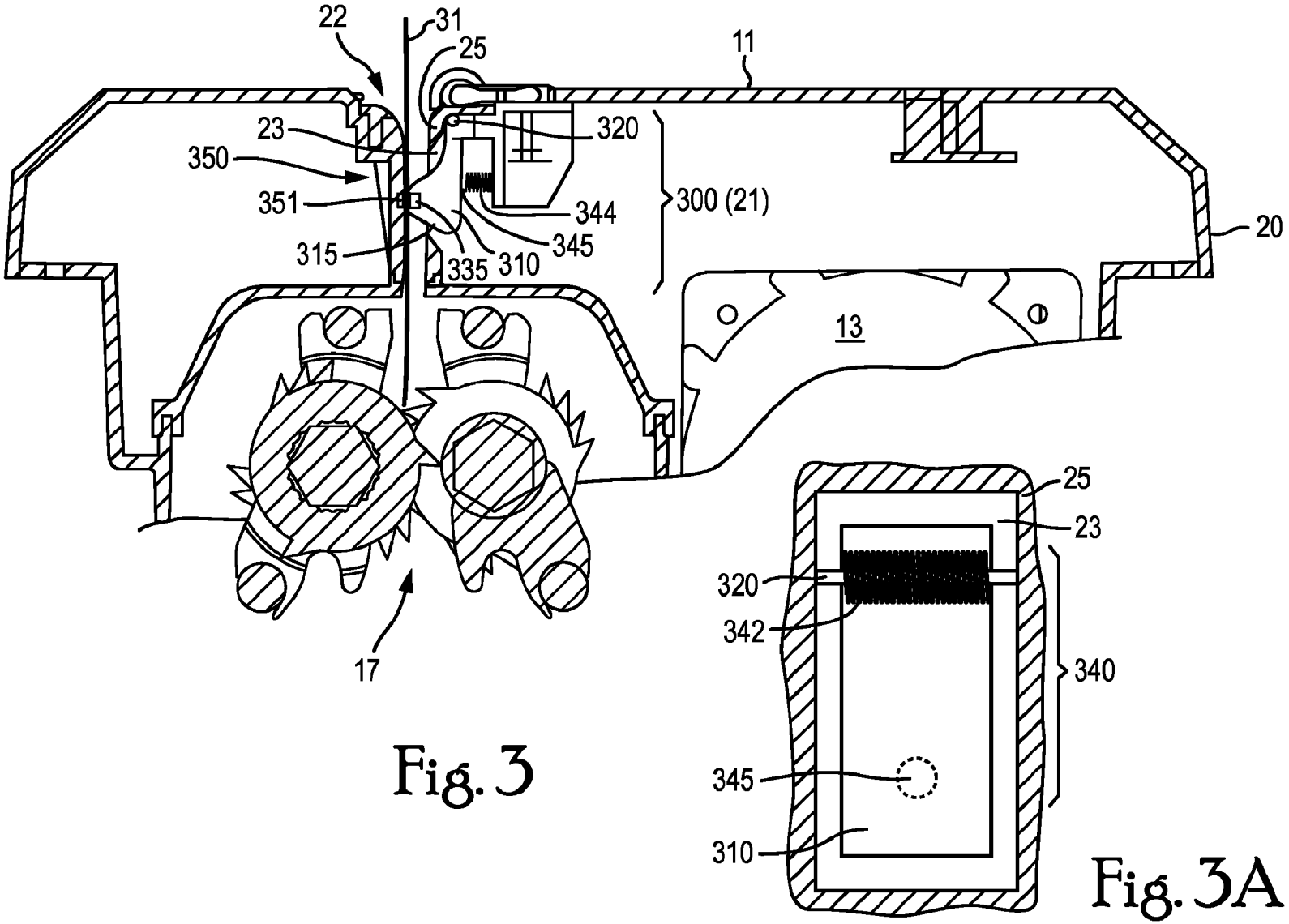
FIG. 3 shows a second embodiment for a thickness detector that may be used to detect the thickness of articles that are placed in the throat of the shredder.
FIG. 3A shows a cross-sectional view of a side opening in the throat of the shredder.

FIG. 3 shows a second embodiment 300 for a thickness detector 21 that may be used to detect the thickness of articles that are placed in the throat 22 of the shredder 10.

The figure shows a cross-sectional view of the throat 22 with the thickness detector 300 assembled therein. Like the embodiment shown in FIG. 2, the throat 22 includes a narrow rectangular slot for receiving at least one article 31 to be shredded. Two sidewalls of the slot are shown therein. A side opening 23 in one sidewall 25 of the throat 22 may be provided for allowing the thickness detector 300 to extend and to displace therethrough with respect to the opposite sidewall. While opening 23 is shown in the figure being on the right side of the throat 22, it will be appreciated that it may also be oriented on the left side of the throat 22.

The thickness detector 300 may include a contact member 310 that extends through the opening 23 and into the throat 22. The contact member 310 is displaceable in response to the article being inserted into the throat 22. In one implementation, the contact member 310 may include a cam mechanism 315 that pivots or rotates as the article 31 passes. As shown in FIG. 3, the contact member 310 may be pivotable about a pivot 320 (such as an axle or a shaft).

Depending on the thickness of the article 31, the cam mechanism 315 of the contact member 310 will be displaced as the user inserts an article into the throat 22. A zero point reference may be established when no article is inserted in the throat 22, and the contact surface 310 abuts the opposite sidewall of the throat 22.

FIG. 3A shows a cross-sectional view of the side opening 23 in the throat A resistance generating mechanism 340 may be connected to the contact member 310, so as to provide a resistance force in response to the contact member 310 displacing. The resistance generating mechanism 340 may include at least two spring mechanisms serially arranged, such as, a first spring mechanism 342 and a second spring mechanism 344.

The resistance force generated by the resistance generating mechanism 340 will create a frictional force against an article 31 which may be felt by the user, especially when trying to feed articles into the throat 22.

This resistance force may provide an immediate feedback to the user. As the user inserts article(s) 31 into the throat, the user will sense the resistance force being applied by the resistance generating mechanism 340. The resistance force also helps to bias the contact member 310 to return to its original position (i.e., the zero point reference) when no article 31 is present in the throat 22.

The first spring mechanism 342 may be attached directly to the contact member 310 proximate to the pivot 320. Thus, as the contact member 310 is displaced so is the first spring member 342. On the other hand, the second spring mechanism 344 may not be fixed to the contact member 310. In another implementation, the second spring mechanism 244 includes a floating end 345 (shown in dotted line form in FIG. 3A) which the contact member 310 engages only after the contact member 310 has displaced a predetermined distance $d_p$ (FIG. 6). For example, a surface of the cam mechanism 315 may contact the floating end 345 causing the second spring mechanism 344 to displace with the contact member 310.

The first spring mechanism 342 may be configured to provide to a first resistance force to the contact member 310. The first spring mechanism 342 may be a torsion spring having a spring constant that obeys Hooke's Law (e.g., a substantially constant ratio of force to displacement). In one implementation, the first spring mechanism 342 may be a "soft" torsion spring having a relative low spring constant of about 0 to 1 N/m.

Displacement of the contact member 310 about the pivot 320 generates a very small resistance force via the first spring mechanism 342. For example, the first spring mechanism 342 may be selected to provide only a small resistance force tending to return the contact member 310 to its original position (i.e., the zero point reference).

On the other hand, the second spring mechanism 344 may be configured to provide a second resistance force, once the contact member 310 displaces a distance greater than the predetermined thickness $d_{p,}$.

In one implementation, the second spring mechanism 344 provides a resistance force much greater than that of the first spring mechanism 342. For example, the second spring mechanism may be a "hard" linear spring having a relatively large spring constant of about 1.0 to 2.5 N/m. As such, once the predetermined thickness $d_{p,}$ has been exceeded, continued displacement by the contact member 310 will result in a significant increase in the resistance force. In other implementations, a non-linear spring might also be used for the second spring mechanism 344.

In addition to or as an alternative to the resistance generating mechanism 340, a thickness sensor 350 may be arranged and configured to accurately measure the displacement of the contact member 310. In one embodiment, a Hall effect sensor assembly 350 may be used. For example, the Hall effect sensor assembly 350 may be attached to a printed circuit board (PCB) that is connected to the controller 35

(FIG. 4). As shown in FIG. 3, the Hall effect sensor assembly 350 may be located proximate to the contact surface of the cam mechanism 315.

When an article is inserted into the throat, it will cause the cam mechanism 315 to rotate a certain angle. The Hall effect sensor assembly 350 includes a Hall effect sensor 335.

In one implementation, the Hall effect sensor assembly 350 may include a Neodymium-Iron-Boron (NdFeB) permanent magnet 351 which provides a magnetic field. Movement of the Hall effect sensor 335 within the magnetic field generates a voltage potential in the sensor 335 that may be related to displacement of the contact member 310.

Other types of magnets might be similarly used as well. As the cam mechanism 315 moves relative to magnet 351, a corresponding output voltage of the Hall effect sensor 335 will be generated.

The controller 35 may be configured to correlate the output voltage of the Hall effect sensor 335 to the angular displacement of the cam mechanism 315. The locations of the Hall effect sensor 335 and the magnet 351 could be reversed in some implementations.

In another embodiment (not shown), in order to compensate for deformation of the throat and the influence of temperature, two halls sensors and two magnets might also be used. One magnet may be placed in the end of the arm of the contact member corresponding to a first hall sensor (as in FIG. 2), and the other in place in one side of the throat adjacent to a second hall sensor positioned in the contact member (as in FIG. 3).

The contact member displaces as the material is inserted into throat 22. In some implementations, the contact member 23 may translate laterally, rotate (pivot), or both. Various contact members mechanisms are further disclosed, for example, in U.S. Patent Application Publication No. 2007/0246585, mentioned above, which may be used in accordance with one or more embodiments disclosed herein.

FIG. 4 shows an exemplary control architecture, in accordance with an embodiment.

The thickness detector 21 is configured to detect the thickness of the articles 31 received by the throat 22 of the shredder 10, and to relay an output to the controller 35. The controller or control circuit 35 is then able to adjust or vary the running operation of the motor based on detected thickness output received from the detector 21.

For example, the controller 35 may be configured to adjust the speed (velocity), torque or power of the motor 13 responsive to the detector 21 detecting the thickness of the at least one article 31 received by the throat 22. Similarly, the controller 35 may be configured to shut the motor 13 down, so as to stop driving the shredder mechanism 17. These modes may be selected to prevent jamming and damage of the motor 13 and/or the shredder mechanism 17.

In some embodiments, the controller 35 may also be configured to provide a warning or alarm, via indicator 18, to alert a user responsive to the detector 21 detecting that the thickness of the at least one article 31 is greater than the predetermined thickness threshold. The alarm indication may include illuminating a visual indicator and/or sounding an audible alarm indicator. The controller 35 may include a microcontroller or a timer circuit. For example, the controller 35 may be configured to vary running operation of the motor 13 continuously responsive to the detector detecting the thickness of the at least one article received by the throat. Further, the controller 35 may be configured to vary running operation of the motor based on predefined discrete ranges of thicknesses responsive to the detector detecting the thickness of the at least one article received by the throat.

Figure 5:
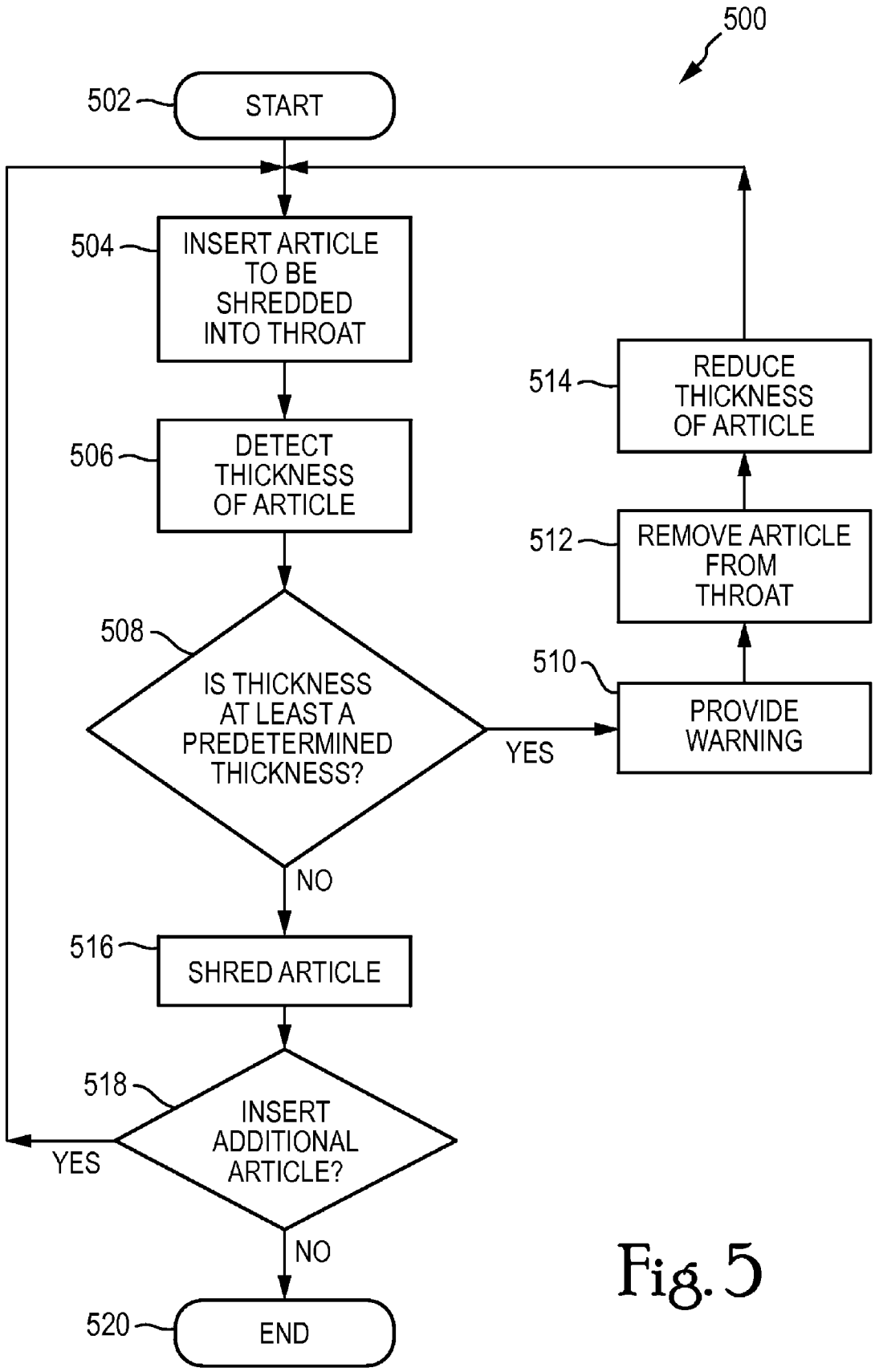
FIG. 5 shows an exemplary method for detecting the thickness of an article being fed into the throat of the shredder, in accordance with an embodiment.

FIG. 5 shows an exemplary method 500 for detecting the thickness of an article being fed into the throat 22 of the shredder 10.

The method starts at step 502. At step 504, the article is fed into the throat 22 of the shredder 10 by the user. At step 506, the detector 21 detects the thickness of the article.

Continuing to step 508, the controller 35 determines whether the thickness that has been detected is greater than the predetermined thickness. The predetermined thickness may be based on the capacity of the shredder mechanism 17, as discussed above. If the controller 35 determines that the thickness that has been detected is at least the predetermined thickness, at step 510, a warning indication may be provided. For example, to provide the warning, the controller 35 may provide a visible signal and/or audible sound to be emitted by one or more indicators 18. In addition or alternatively, the controller may cause power to be disrupted to the motor 13 so that the shredder mechanism 17 will not shred the article. The user should then remove the article from the throat 22 of the shredder 10 at step 512, and reduce the thickness of the item at step 514 before inserting the article back into the throat 22 at step 504.

If the controller 35 determines that the thickness that has been detected is less than the predetermined thickness, the controller 35 may provide a visible signal and/or audible sound to indicate to the user that it is safe to continue shredding. In addition or alternatively, power may be supplied to the motor 12 so that the shredder mechanism 17 may proceed with shredding the article at step 516.

At step 518, the user may insert an additional article (or articles), such as additional sheets, documents or stack of documents, as the shredder mechanism 16 is shredding the previous article that was fed into the throat 22 of the shredder at step 504. If the user does insert an additional article into the throat 22 at step 518, the method returns to step 504, and the thickness detector 21 detects the thickness of the article at the location of the thickness detector 21 at step 506, and so on. If part of the previous article is still in the throat 22, the cumulative thickness of the article(s) being shredder and the new article may be detected. If the user does not add an additional article at step 518, the method ends at step 520. The illustrated method is not intended to be limiting in any way.

FIG. 6 shows a plot of the displacement of the contact member of the thickness detector and the resistance provided, in accordance with an embodiment.

As the plot shows, when an article is inserted into the throat, the thickness of the article will cause the contact member to displace a certain distance. Up until the predetermined displacement distance $d_p$ only the first spring mechanism will be engaged. For example, the resistance of the first spring mechanism may be will be substantially linear with respect to displacement (according to Hooke's Law).

However, once the contact member displaces a distance exceeding the displacement distance $d_p$, the second spring mechanism then engages. The resistance force, thereby abruptly changes, as shown in the plot. Upon further displacement, both the first and second spring mechanisms cooperate together. Assuming that both the first and second spring mechanisms are linear, the resistance will be substantially linear with displacement according to Hooke's Law. As will be appreciated, the combination of the two spring mechanisms provides a much greater resistance force than the first spring mechanism may provide. This is evident from the slope of the plot, before and after, the displacement distance $d_p$.

In one embodiment, the predetermined displacement distance $d_p$ may correspond to a predetermined thickness of the article (i.e., the thickness that can be accommodated by the shredder). For example, the displacement distance $d_p$ may correspond to 5 sheets of 20 lb paper (e.g, approximately 0.5 mm).

Although the various embodiments disclosed herein employ particular sensors, it is to be noted that other approaches may be employed to detect the thickness of the stack of documents or articles being fed into the throat 22 of the shredder 10. For example, the thickness detection sensor 21 may include, but is not limited to, strain gauges, optical sensors, capacitance sensors, piezoelectric, eddy current, inductive, photoelectric, ultrasonic, hall effect, and/or infrared proximity sensor technologies. Reference may be made to U.S. Patent Application Publication No. 2006/0219827, mentioned above, for details of a detector that is configured to detect a thickness of the at least one article received by the throat. The detector may have any construction or configuration, and the illustrated embodiment is not limiting. Other sensor technologies may also be possible. In one embodiment, the Hall effect sensors shown in the FIGS. 2-3 could be replaced by a piece of metal and the magnet(s) could be replaced by capacitance sensors (or vice versa).

The terms "spring" and "spring mechanism," as used herein, include any structure that provides a resilient restoring and/or resistive force, such as, for example, solid elastomer member (e.g., rubber, foam, elastic, or the like), metal spring, a fluid or gap damper, linear spring, torsion spring, leaf spring, a weight, etc.

All patents and/or patent applications mentioned hereinabove are hereby incorporated by reference in their entireties.

While this disclosure has been described in connection with what is presently considered to be the most practical embodiment, it is to be understood that it is capable of further modifications and is not to be limited to the disclosed embodiment, and this application is intended to cover any variations, uses, equivalent arrangements or adaptations of the disclosure following, in general, the principles of the invention and including such departures from the present disclosure as come within known or customary practice in the art to which the disclosure pertains, and as may be applied to the essential features hereinbefore set forth and followed in the spirit and scope of the appended claims.

What is claimed is:

1. A shredder comprising:

a housing having a throat for receiving at least one article to be shredded;

a shredder mechanism positioned downstream of the throat in the direction that the articles are fed; and a contact member that is configured to displace as the article passes through the throat; and a resistance generating mechanism for resisting displacement of the contact member, the resistance generating mechanism comprising:

(i) a first spring configured to resist displacement of the contact member at least up to a predetermined displacement; and (ii) a second spring configured to resist displacement of the contact member beyond the predetermined displacement, wherein the first and second springs are configured such that the ratio of force to displacement is lower below the predetermined displacement and greater beyond the predetermined displacement.

2. The shredder according to claim 1, further comprising:

a sensor associated with the contact member and configured to measure the thickness of articles fed into the throat.

3. The shredder according to claim 1, wherein the second resistance is a combination of the first and second resistance forces.

4. The shredder according to claim 1, wherein each of the first and second springs is one of a torsion spring or a liner spring.

5. The shredder according to claim 1, wherein one of the first and second springs is a torsion spring and the other of the first and second springs is a linear spring.

6. The shredder according to claim 1, wherein the contact member comprises a cam mechanism having a surface which contacts the article.

7. The shredder according to claim 6, wherein the contact member further comprises an arm extending away from the cam mechanism.

8. The shredder according to claim 2, wherein the sensor is a Hall effect sensor or a capacitance sensor.

9. The shredder according to claim 8, where the hall-effect sensor comprises at least one NdFeN permanent magnet.

10. The shredder according to claim 8, wherein the hall-effect sensor comprises two magnets spaced apart.

11. The shredder according to claim 1, wherein the throat include a side opening permitting the contact member to displace therethrough.

12. The shredder according to claim 1, one or both of the first and second spring comprise: an elastomer member, weight, fluid or gap damper, linear spring, torsion spring, or leaf spring.

13. A method of shredding comprising:

inserting an article to be shredded into a housing having a throat for receiving articles to be shredded;

displacing a contact member positioned in the throat, wherein the displacement corresponds to the thickness of the article in the throat;

generating a resistance as the contact member displaces, said generating comprising:

(i) providing a first resistance configured to resist displacement of the contact member at least up to a predetermined displacement; and (ii) providing a second resistance configured to resist displacement of the contact member beyond the predetermined displacement, wherein the first and second resistances are configured such that the ratio of force to displacement is lower below the predetermined displacement and greater beyond the predetermined displacement.

14. The method according to claim 13, further comprising:

measuring, with a sensor, the thickness of articles fed into the throat.

15. The method according to claim 13, wherein the second resistance is a combination of first and second resistances.

16. The method according to claim 13, wherein each of the first and second resistances is generated using one of a torsion spring or a liner spring.

17. The method according to claim 13, wherein one of the first and second resistances is generated using a torsion spring and the other of the first and second resistances is generated using a linear spring.

18. The method according to claim 13, wherein the contact member comprises a cam mechanism having a surface which contacts the article.

19. The shredder according to claim 13, further comprising:

providing an alert in response to the sensor measuring the thickness of the said articles.

20. The method according to claim 13, further comprising:

altering the shredding in response to the sensor measuring the thickness of the said articles.

21. The method according to claim 20, wherein the altering comprises:

adjusting the speed, torque or power of the shredding.

22. The method according to claim 20, wherein the altering comprises:

deactivating the shredding.

23. The method according to claim 13, wherein providing one or both of the first and second resistance forces comprise providing a spring.

24. The method according to claim 23, wherein the spring comprises: an elastomer member, weight, fluid or gap damper, linear spring, torsion spring, or leaf spring.

* * * * *